US008915191B2

(12) United States Patent
Jones

(10) Patent No.: US 8,915,191 B2
(45) Date of Patent: Dec. 23, 2014

(54) SPIN STABILIZED AND/ OR DRAG STABILIZED, BLUNT IMPACT NON-LETHAL PROJECTILE

(76) Inventor: Kenneth R. Jones, Wayne, NJ (US)

( * ) Notice: Subject to any disclaimer, the term of this patent is extended or adjusted under 35 U.S.C. 154(b) by 172 days.

(21) Appl. No.: 13/433,483

(22) Filed: Mar. 29, 2012

(65) Prior Publication Data

US 2012/0291655 A1 Nov. 22, 2012

Related U.S. Application Data

(60) Provisional application No. 61/468,747, filed on Mar. 29, 2011.

(51) Int. Cl.

| | |
|---|---|
| ***F42B 8/12*** | (2006.01) |
| ***F42B 8/14*** | (2006.01) |
| ***F42B 12/34*** | (2006.01) |
| ***F42B 10/24*** | (2006.01) |
| ***F42B 10/26*** | (2006.01) |
| ***F42B 10/06*** | (2006.01) |

(52) U.S. Cl.

CPC . *F42B 8/14* (2013.01); *F42B 12/34* (2013.01); *F42B 10/24* (2013.01); *F42B 10/26* (2013.01); *F42B 10/06* (2013.01)

USPC ..... 102/502

(58) Field of Classification Search

USPC ..... 102/502

See application file for complete search history.

(56) References Cited

U.S. PATENT DOCUMENTS

| | | | | |
|---|---|---|---|---|
| 4,008,667 | A * | 2/1977 | Look | 102/502 |
| 6,209,461 | B1 * | 4/2001 | Riffet et al. | 102/513 |
| 7,743,708 | B1 * | 6/2010 | Lawrence | 102/502 |
| 8,485,102 | B2 * | 7/2013 | Carlson et al. | 102/513 |

* cited by examiner

*Primary Examiner* — Daniel J Troy

(74) *Attorney, Agent, or Firm* — The McHattie Law Firm; John Baldini, Esq.

(57) ABSTRACT

A spin stabilized and drag-stabilized, blunt impact, non-lethal projectile is provided, having a rigid base and rigid windscreen, with a compressible body therebetween, thereby enabling use thereof in high pressure/compression firing mechanisms, but yet operable to compress/deform upon impact with a target. In particular, a spin stabilized, blunt impact, non-lethal projectile is provided having a rigid windscreen and base, with a compressible body therebetween which compresses/deforms upon impact with a target. In addition, a drag-stabilized version thereof is provided, having canted fins thereon so as to control flight of the projectile via the imposition of drag thereon. Additionally, the projectile is capable of carrying agents, such as crowd control and marking agents, in an agent reservoir, and ejecting same onto a target upon impact.

26 Claims, 25 Drawing Sheets

SPIN STABILIZED AND/ OR DRAG STABILIZED, BLUNT IMPACT NON-LETHAL PROJECTILE

CROSS REFERENCE TO A RELATED APPLICATIONS

This is a non-provisional application of co-pending provisional application No. 61,468,747, filed Mar. 29, 2011, the contents of which are incorporated herein by reference.

BACKGROUND OF THE INVENTION

1. Field of the Invention

A spin stabilized and drag stabilized, blunt impact, non-lethal projectile is provided, having a rigid base, a rigid windscreen and a compressible body therebetween, enabling use thereof in high pressure/compression firing mechanisms, but yet operable to compress/deform upon impact with a target via deformation of the compressible body. In particular, a spin stabilized, blunt impact, non-lethal projectile is provided having a rigid windscreen and base, with a compressible body therebetween which compresses/deforms upon impact with a target.

2. Description of the Related Art

In general, previous non-lethal kinetic energy projectiles have been designed for relatively short range encounters, usually in the 7 meter to 15 meter range. To achieve a high probability of hit on a specific human target, at these ranges, a high degree of ballistic accuracy is not necessary. It is quite possible to obtain this level of performance from an aerodynamically unstable projectile. However, hit probability diminishes rapidly when attempting to engage beyond these ranges. This is due to inconsistent aerodynamic forces generated by unstable, and possibly inconsistent, projectile shapes.

Projectiles currently available for non-lethal operations range from various sized rubber balls, right circular cylinder wood, rubber, or other "baton" munitions, bean bag style sacks, electrified stun devices, a drag stabilized rubber bullets. In addition, a spin stabilized, rigid based, compliant nosed blunt impact projectile is available. The most familiar version of this is the US military designated M1006. This is an approximately 30 gram, 40 mm "sponge grenade" which is fired from hand-held or stationary, low velocity grenade launchers such as the M203, M320, Multi-shot M32. Various forms of this type of round such as 37 mm versions used for law enforcement, animal control, etc., heavier versions, drag stabilized versions, marking and irritant versions, etc.

The range of these conventional non-lethal projectiles is typically 10 to 50 meters, with some having some utility beyond those ranges, but most being used at either shorter ranges or only longer ranges mainly due to levels of impact non-lethality. The compliant (soft) nose impacts the target and the impact energy produces the desired effect. The M1006 for example, has a closed cell polyolefin foam nose. Some have neoprene foam, and other have rubber over foam. The M1006 has an open base, high drag body. It was designed for short range use and is incapable of precision flight and impact utility out beyond 50 meters. Specifically, although the M1006 will fly farther than 50 m, it hits the target with so little force (i.e., so little kinetic energy is delivered), it is useless. In addition, due to the non-rigid nose (and sometimes base), such conventional non-lethal projectiles are damaged by the weapon by forces exerted thereon in the breach, as well as have deficient aerodynamic characteristics during flight.

In order to achieve a desired level of performance, a spin-stabilized projectile with a low drag shape is preferred. This would allow the projectile to reach a range significantly greater than current state-of-the-art non-lethal projectiles, without losing considerable velocity, while maintaining a predictable flight path. The method of propulsion typically employed for previous designs included a charge of black powder which was ignited by a percussion primer. The reduced mass and low velocity required for non-lethal projectile applications restricts the working pressure to a level that modern smokeless powders will not deflagrate (burn) consistently. This generally produces large deviations in muzzle velocity and often leaves partially consumed powder in the cartridge case and weapon bore. Further, as stated above, such conventional non-lethal cartridges are damaged by the forces exerted thereon by the weapon.

Accordingly, it is an object of the present invention to provide a projectile designed to impart a non-lethal impact to a human target over a wide range of distances. In addition, it is an object of the present invention to provide a projectile capable of maintaining low dispersion and retaining adequate terminal velocity, such that the projectile remain effective at extended ranges. Lastly, it is an object of the present invention to provide a projectile capable of being loaded into cartridges designed to be fired from several existing U.S. military weapons with no modifications needed thereto.

SUMMARY OF THE INVENTION

In order to achieve the objects of the present invention as described above, the present inventor endeavored to provide a spin stabilized/drag stabilized, blunt impact, non-lethal projectile having sufficient range and velocity, while still capable of "usable" non-lethal effects (i.e., deliverance of sufficient kinetic energy) upon the target. Accordingly, in a first embodiment of the present invention, a spin stabilized, blunt impact, non-lethal projectile is provided comprising:

(a) a compressible body having a front end, a base opposite the front end, and a body portion therebetween, said body portion having an outer circumference;

(b) a rigid windscreen disposed on/adjacent to the front of the compressible core, so as to cover a portion thereof; and (c) a rigid base cap disposed on/adjacent to the base of the compressible body, so as to cover a portion thereof, wherein the compressible body is comprised of a compressible material and/or frangible material operable to compress and/or flex upon impact of the projectile.

In a second embodiment of the present invention, the spin stabilized, blunt impact, non-lethal projectile of the first embodiment above is provided, wherein the compressible body further comprises one or more hollow cores disposed within the body portion, said hollow cores extending substantially from the front end to the base. These one or more hollow cores are operable to enable greater deformation of the compressible body and/or allow more compression of the compressible body so as to absorb more energy upon impact of the projectile. In a third embodiment of the present invention, the spin stabilized, blunt impact, non-lethal projectile of the second embodiment above is provided, further comprising one or more perforations disposed within the compressible body, extending from the one or more hollow cores to the outer circumference of the compressible body.

In a fourth embodiment of the present invention, the spin stabilized, blunt impact, non-lethal projectile of the second embodiment above is provided, further comprising:

an agent reservoir disposed within the compressible body, wherein said agent reservoir is operable to retain one or more agents therein, and release same upon impact of the projectile.

In a fifth embodiment of the present invention, the spin stabilized, blunt impact, non-lethal projectile of the fourth embodiment above is provided, wherein the one or more agents are selected from powders, marking agents, crowd control agents (chemical irritants), toxic compositions and tranquilizers.

In a sixth embodiment of the present invention, the spin stabilized, blunt impact, non-lethal projectile of the second through fifth embodiments above is provided, further comprising:

one or more agent ejection ports disposed within the body portion and windscreen so as to extend from the windscreen to the hollow core, wherein said one or more ejection ports are operable to facilitate transmission of an agent through the one or more agent ejection ports upon impact of the projectile.

In a seventh embodiment of the present invention, the spin stabilized, blunt impact, non-lethal projectile of the first embodiment above is provided, further comprising a weight biasing mass disposed within or adjacent to the forward end of the compressible body, said weight biasing mass operable to alter the center of mass of the projectile.

In an eighth embodiment of the present invention, the spin stabilized, blunt impact, non-lethal projectile of first embodiment above, further comprising one or more spiral grooves disposed within the windscreen, said spiral grooves operable to impart spin to the projectile upon firing thereof.

In a ninth embodiment of the present invention, the spin stabilized, blunt impact, non-lethal projectile of the second embodiment above is provided, further comprising a rotating band disposed around and/or formed integral with the base of the projectile, said rotating band operable to communicate with rifling of a weapon barrel and seal propellant gases to accelerate the projectile.

In a tenth embodiment of the present invention, the spin stabilized, blunt impact, non-lethal projectile of the first embodiment above is provided, further comprising a ring weight disposed integral with, adjacent to or around the projectile, said ring weight operable to increase mass around the circumference of the projectile, thereby increasing gyroscopic stability of the projectile.

In a eleventh embodiment of the present invention, the spin stabilized, blunt impact, non-lethal projectile of the first embodiment above is provided, wherein the rigid base cap decrease in diameter from a front end thereof to a rear end thereof, such that the rear end of the base cap has a diameter smaller than the front end of the compressible body and maximum diameter of the windscreen. This "boat tail" design helps streamline the projectile to prevent turbulence behind it as it travels, thereby reducing drag.

In a twelfth embodiment of the present invention, a drag stabilized, blunt impact, non-lethal projectile is provided according to the eleventh embodiments above, wherein the compressible body further comprises one or more hollow cores disposed within the body portion, and said hollow cores extend substantially from the front and to the base.

In a thirteenth embodiment of the present invention, a drag stabilized, blunt impact, non-lethal projectile is provided according to the eleventh embodiments above, wherein one or more perforations are disposed within the compressible body and extend from the one or more hollow cores to the outer circumference of the compressible body.

In a fourteenth embodiment of the present invention, the spin stabilized, blunt impact, non-lethal projectile of the eleventh embodiment above is provided, further containing an agent reservoir disposed within the compressible body, wherein said agent reservoir is operable to retain one or more agents therein, and release same upon impact of the projectile.

In a fifteenth embodiment of the present invention, the spin stabilized, blunt impact, non-lethal projectile of the present invention is provided according to the fourteenth embodiment wherein the one or more agents are selected from powders, marking agents, crowd control agents (chemical irritants), toxic compositions and tranquilizers.

In a sixteenth embodiment of the present invention, the spin stabilized, blunt impact, non-lethal projectile of the present invention is provided according to the fourteenth embodiment in which one or more agent ejection ports are disposed within the body portion and windscreen so as to extend from the windscreen to the hollow core, wherein said one or more ejection ports are operable to facilitate transmission of an agent through the one or more agent ejection ports upon impact of the projectile.

In a seventeenth embodiment of the present invention, the spin stabilized, blunt impact, non-lethal projectile of the present invention is provided according to the eleventh embodiment above in which a weight biasing mass is disposed within or adjacent to the forward end of the compressible body, and said weight biasing mass is operable to alter the center of mass of the projectile.

In a eighteenth embodiment of the present invention, the spin stabilized, blunt impact, non-lethal projectile of the present invention is provided according to the eleventh embodiment, in which one or more spiral grooves are disposed within the windscreen, said spiral grooves being operable to impart spin to the projectile upon firing thereof.

In a nineteenth embodiment of the present invention, the spin stabilized, blunt impact, non-lethal projectile of the present invention is provided according to the eleventh embodiment, in which a rotating band is disposed around and/or formed integral with the base of the projectile, and said rotating band is operable to communicate with rifling of a weapon barrel.

In a twentieth embodiment of the present invention, the spin stabilized, blunt impact, non-lethal projectile of the present invention is provided according to the eleventh embodiment, in which a ring weight is disposed integral with, adjacent to or around the projectile, and said ring weight is operable to increase mass around the circumference of the projectile, thereby increasing gyroscopic stability of the projectile.

In a twenty-first embodiment of the present invention, the spin stabilized, blunt impact, non-lethal projectile of the present invention is provided according to the first embodiment, in which the rigid base cap decreases in diameter from a front end thereof to a rear end thereof, such that the rear end of the base cap has a diameter smaller than the front end of the compressible body and maximum diameter of the windscreen.

In a twenty-second embodiment of the present invention, the spin stabilized, blunt impact, non-lethal projectile of the present invention is provided according to the eleventh embodiment, in which the rigid base cap decreases in diameter from a front end thereof to a rear end thereof, such that the rear end of the base cap has a diameter smaller than the front end of the compressible body and maximum diameter of the windscreen.

In a twenty-third embodiment of the present invention, the spin stabilized, blunt impact, non-lethal projectile of the present invention is provided according to the fourth embodiment, in which one or more agent ejection ports is disposed within the body portion and windscreen so as to extend from the windscreen to the hollow core, and said one or more ejection ports are operable to facilitate transmission of an agent through the one or more agent ejection ports upon impact of the projectile.

In a twenty-fourth embodiment of the present invention, the spin stabilized, blunt impact, non-lethal projectile of the present invention is provided according to the fifth embodiment, in which one or more agent ejection ports are disposed within the body portion and windscreen so as to extend from the windscreen to the hollow core, and said one or more ejection ports are operable to facilitate transmission of an agent through the one or more agent ejection ports upon impact of the projectile.

In a twenty-fifth embodiment of the present invention, the spin stabilized, blunt impact, non-lethal projectile of the present invention is provided according to the fifteenth embodiment, in which one or more agent ejection ports are disposed within the body portion and windscreen so as to extend from the windscreen to the hollow core, and said one or more ejection ports are operable to facilitate transmission of an agent through the one or more agent ejection ports upon impact of the projectile.

In a twenty-sixth embodiment of the present invention, the spin stabilized, blunt impact, non-lethal projectile of the present invention is provided according to the sixteenth embodiment, in which one or more agent ejection ports are disposed within the body portion and windscreen so as to extend from the windscreen to the hollow core, and said one or more ejection ports are operable to facilitate transmission of an agent through the one or more agent ejection ports upon impact of the projectile.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
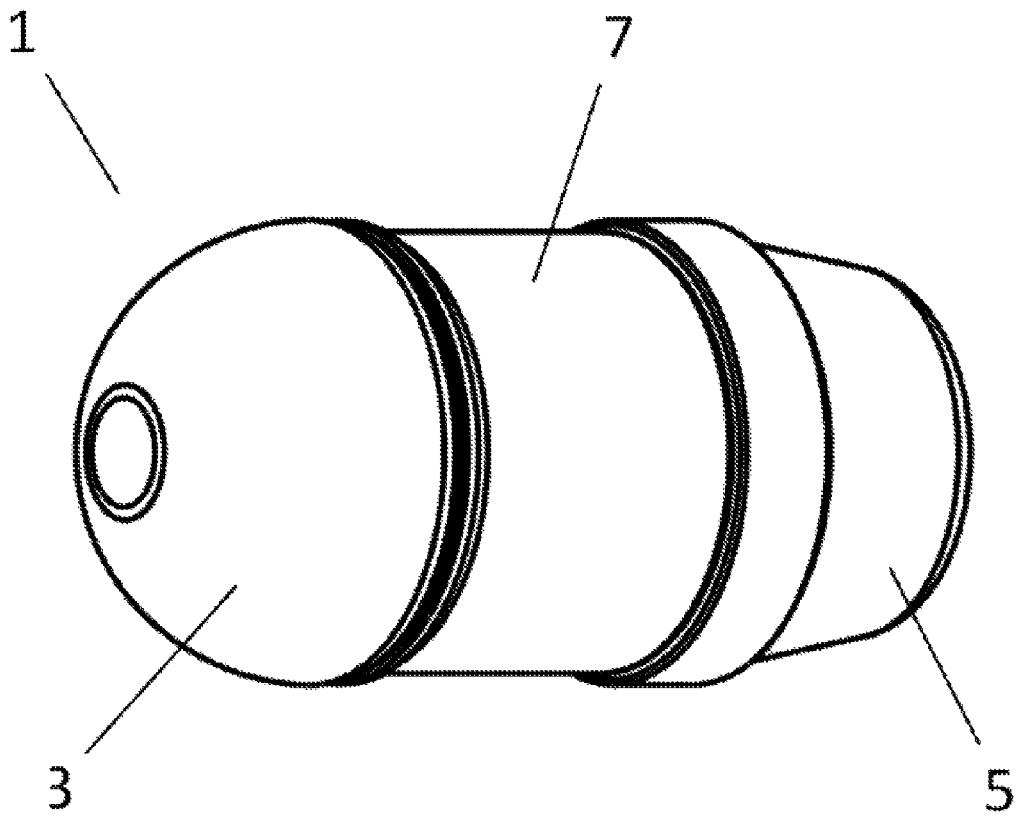
FIG. 1 is a front perspective view of the spin stabilized, blunt impact, non-lethal projectile of the present invention.

The present invention provides a spin stabilized, blunt impact, non-lethal projectile, as well as a drag stabilized, blunt impact, non-lethal projectile, both capable of being fired from conventional weapons, such as an M1002 or MK19, without modification thereof. In particular, as illustrated in FIGS. 1-11, the present invention provides a spin stabilized, blunt impact, non-lethal projectile 1 having a rigid windscreen 3, a rigid base cap 5, and a compressible body 7 therebetween. Preferably, the windscreen 3 and base 5 are formed of a rigid yet lightweight material, such as plastic, a composite, a thinly pressed metal, etc. Further, as illustrated in FIG. 3, the windscreen 3 preferably has a tapered nose cone 13 resulting in a blunt impact face, such that impact thereof with a target is non-lethal to the target.

As mentioned above, both the base cap and windscreen are rigid. This rigidity provides a "double mass" round, i.e., although the rigid windscreen first strikes the target hard, the compressible body is then compressed/deformed. Thus, the total mass of the projectile 1 is not felt by the target as one blunt object strike. Rather, the target experiences two mass impacts, i.e., the impact of the rigid windscreen 3, and upon the complete compression/deformation of the compressible body 7, the second impact milliseconds later of the mass of the compressible body 7 and base 5. Thus, the compressible body 7 provides a drawn out, lower energy impact upon a target than would impact of a solid rigid object.

Figure 23:
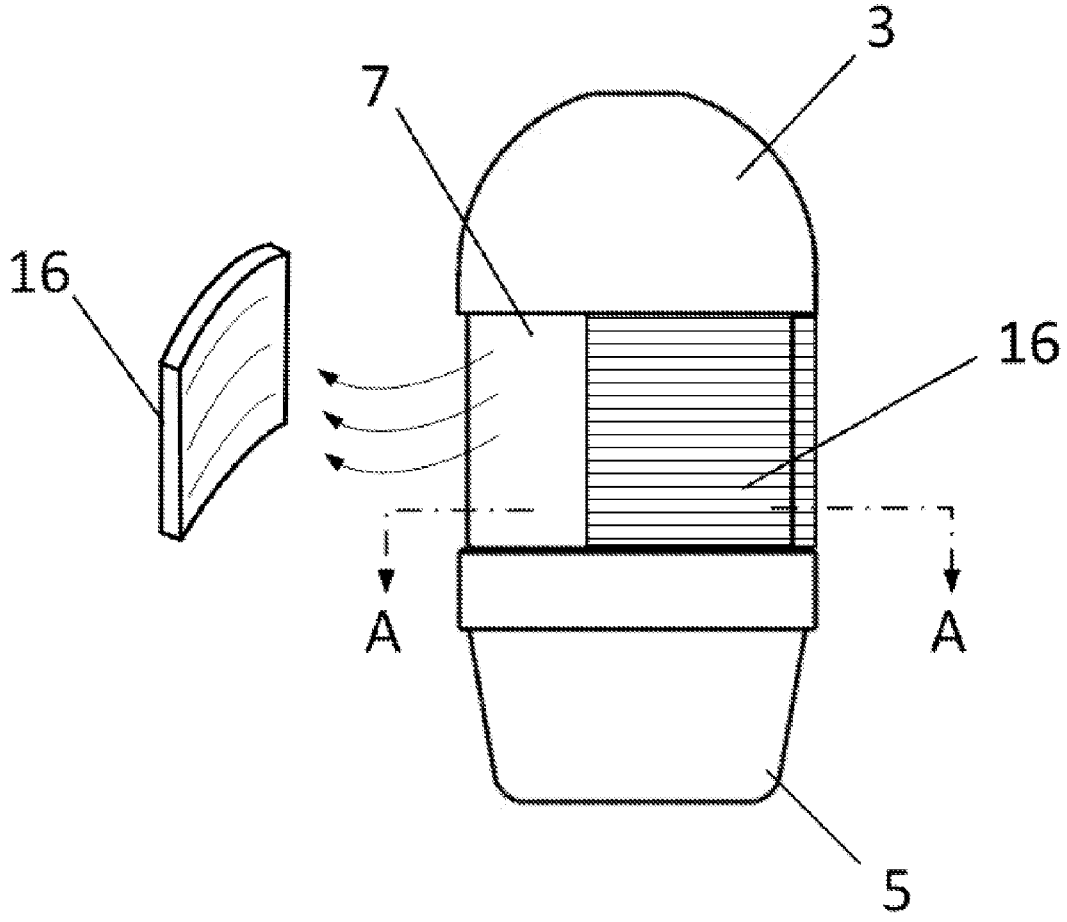
FIG. 23 is a side view of the projectile of the present invention, illustrating the disposable/fall away supports which function to prevent compression of the projectile during firing.
Figure 24:
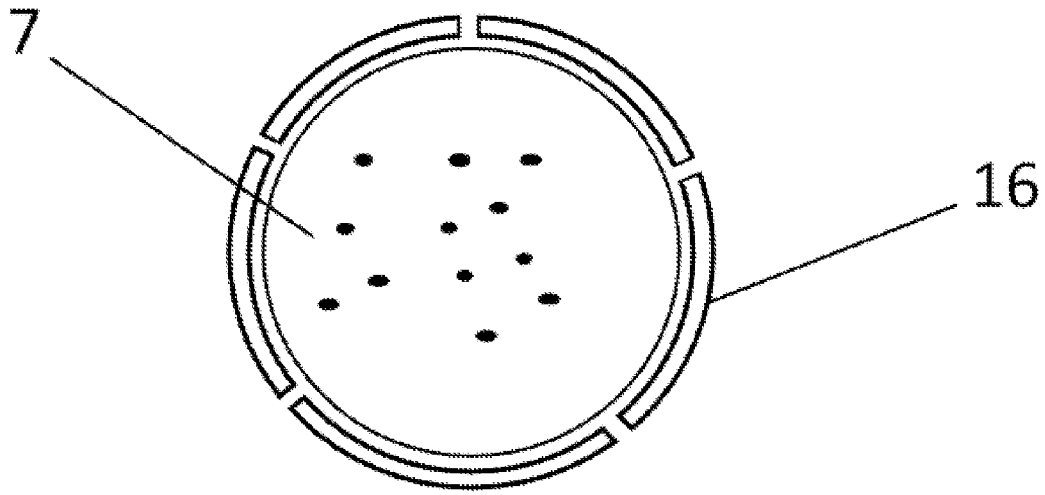
FIG. 24 is a cross sectional top view of the projectile of the present invention shown in FIG. 24, illustrating the disposition of the supports relative to the compressible body.
Figure 25:
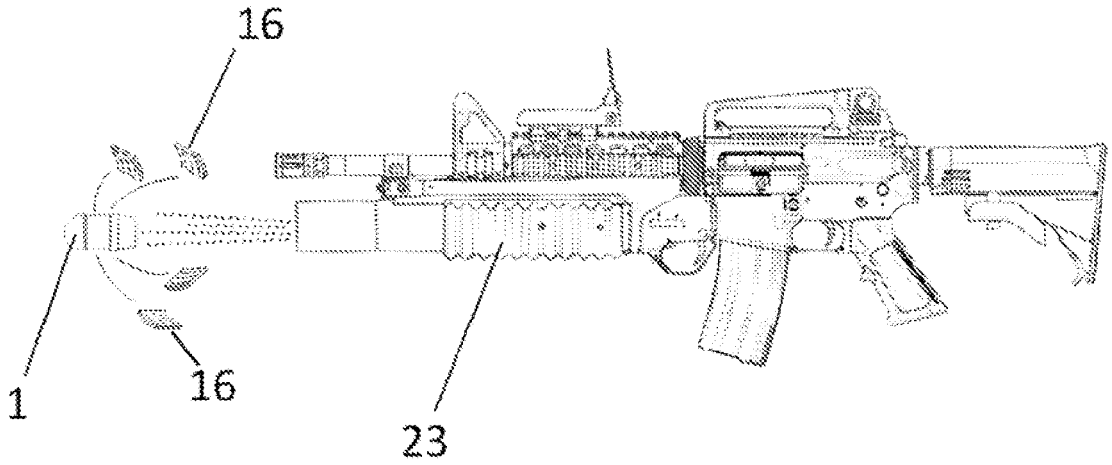
FIG. 25 is a side view of a weapon and projectile of the present invention shortly after firing of the projectile, illustrating how the supports fall away from the projectile upon exiting of the projectile from the barrel.

In addition, the rigidity of the windscreen and base (which prevent the compressible body from being compressed within the weapon) allows the projectile to be used in high pressure weapons, such as the MK19, wherein the ogive plunger applies a pressure of 900 lbs. upon the projectile. Further, supports 16, as shown in FIGS. 23 and 24 are preferably disposed around the compressible body 7, between the base 5 and windscreen 3 to provide enhanced strength and rigidity during the firing event. These supports 16 may be simply press fit in, or lightly adhere to the projectile such that, as illustrated in FIG. 25, they fall away from the projectile after the projectile exits the weapon.

Further, preferably, the rigid base cap 5 has a tapered circumference 35, i.e., the rigid base cap decreases in diameter from a front end thereof to a rear end thereof, such that the rear end of the base cap has a diameter smaller than the front end of the compressible body and maximum diameter of the windscreen, as illustrated in FIG. 3. By tapering the rigid base cap 5, drag is decreased, thereby increasing range of the projectile after firing, i.e., velocity decay is greatly decreased in comparison to other non-lethal rounds. Further, the effects provided by the tapered outer circumference 35 allows firing of the projectile at a much lower velocity than other non-lethal rounds, thereby improving the non-lethality of the projectile. Thus, the projectile of the present invention can be fired slow enough to be non-lethal at short range, yet maintain a long effective range, whereas other non-lethal rounds are generally lethal at short range, as they need to be fired at relatively high velocity to enable sufficient range, which increase lethality.

As illustrated in FIGS. 2, 8, 9 and 10, one or more hollow cores 9 may be formed within the compressible body, so as to allow greater deformation of the compressible body 7 upon impact with a target than would have been possible without the hollow core(s) 9. The hollow core(s) 9 aids in the compression effect. Specifically, the compressible body 7 can only compress so much before it reaches a maximum level where there is no place for the foam, rubber, etc. which makes up to the compressible body 7 to expand into or stretch to move more. By adding the hollow core(s) 9, the compressible body 7 is allowed to expand inward and outward using the inner void created by the hollow core(s) 9.

Figure 2:
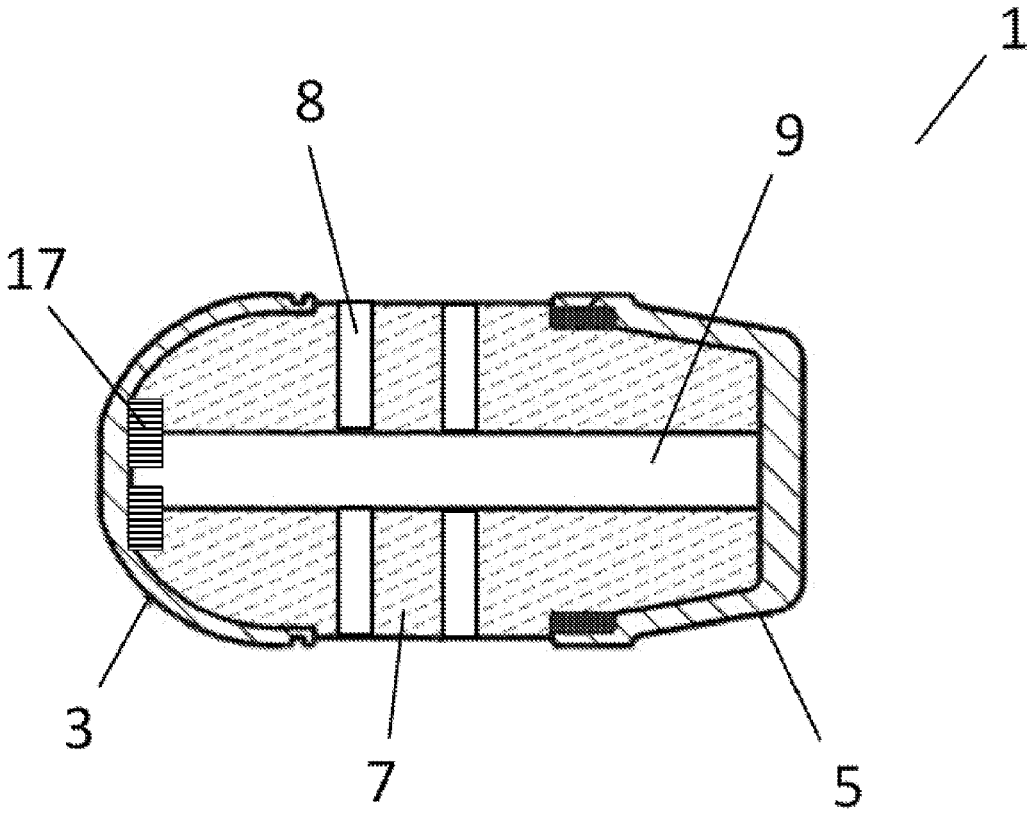
FIG. 2 is a cross sectional view of the spin stabilized, blunt impact, non-lethal projectile of the present invention, illustrating the hollow core disposed within the compressible body, and the weight biasing mass.
Figure 3:
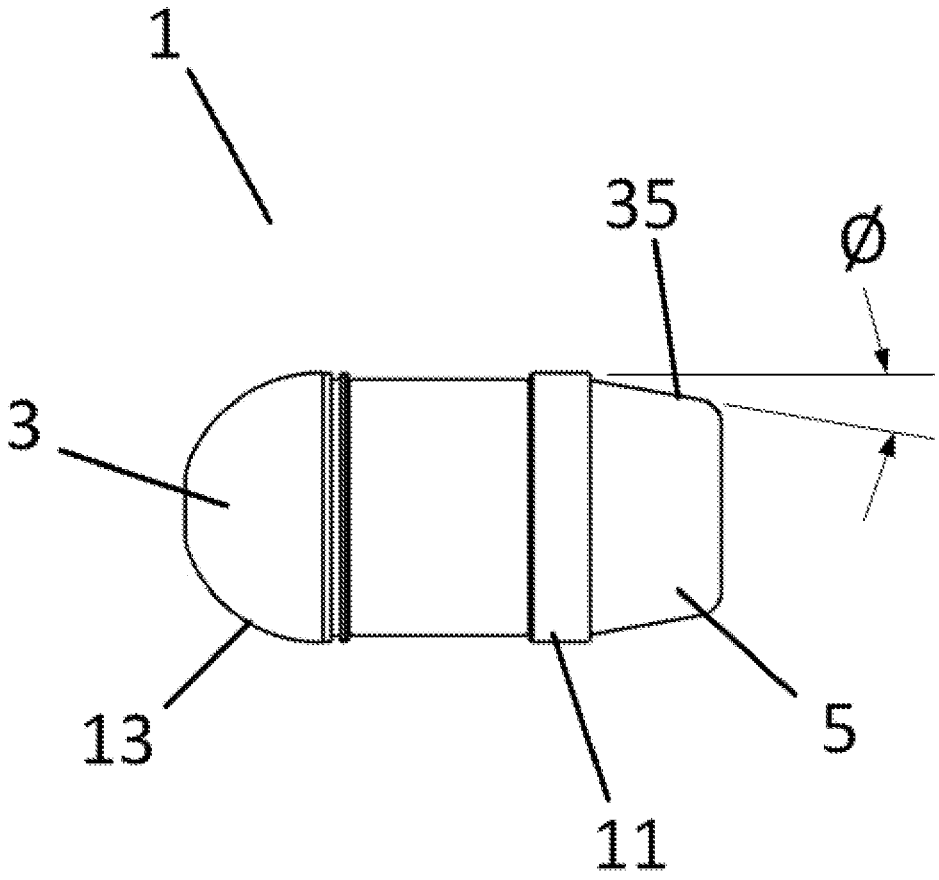
FIG. 3 is a side view of the spin stabilized, blunt impact, non-lethal projectile of the present invention, illustrating the tapered rigid base cap.
Figure 8:
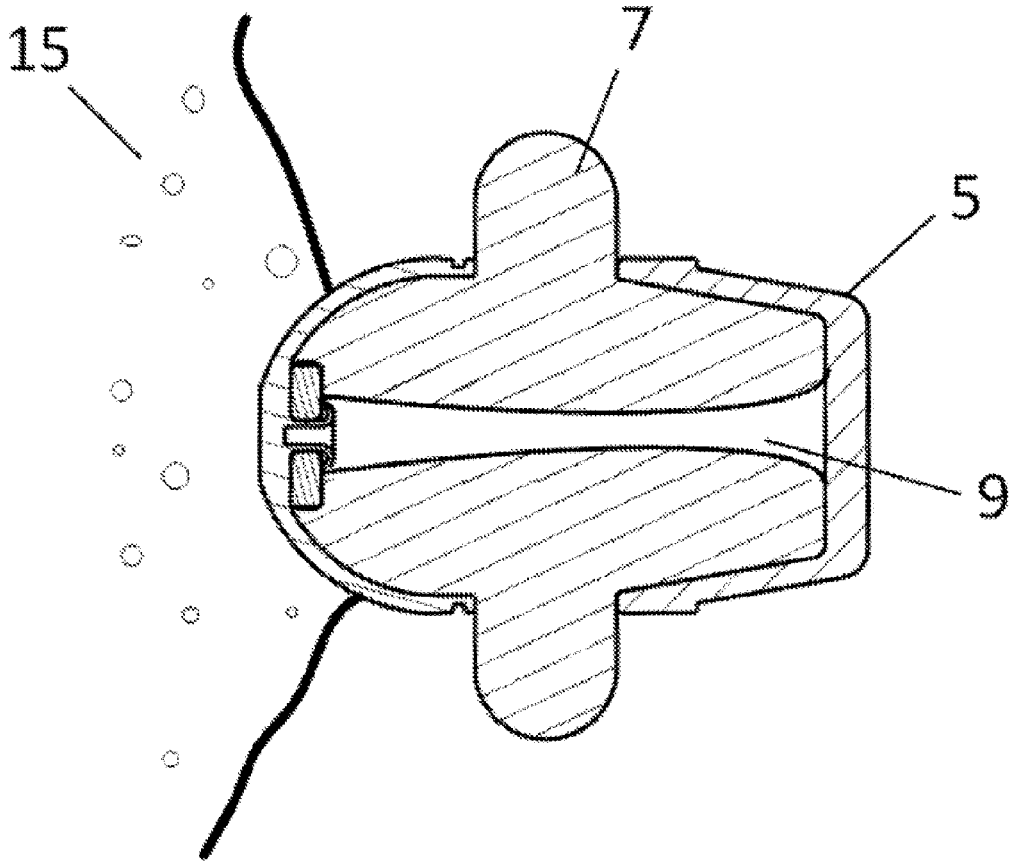
FIG. 8 is a cross sectional view of the projectile shown in FIGS. 4-7, illustrating the compression/deformation of the compressible body after impact of the projectile upon the target.
Figure 9:
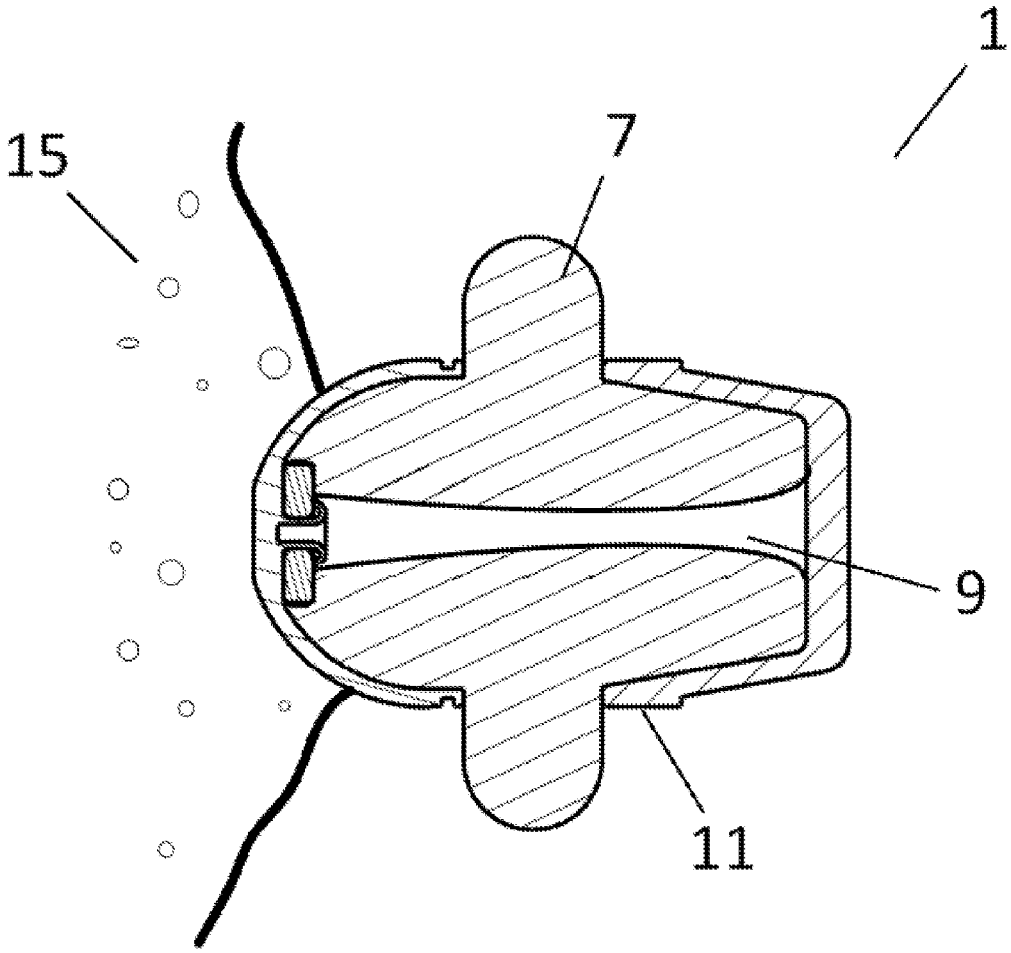
FIG. 9 is a cross sectional view of the spin stabilized, blunt impact, non-lethal projectile of the present invention, illustrating the lateral deformation of the compressible body upon impact thereof with the target, and the effect thereon provided by the hollow core.
Figure 10:
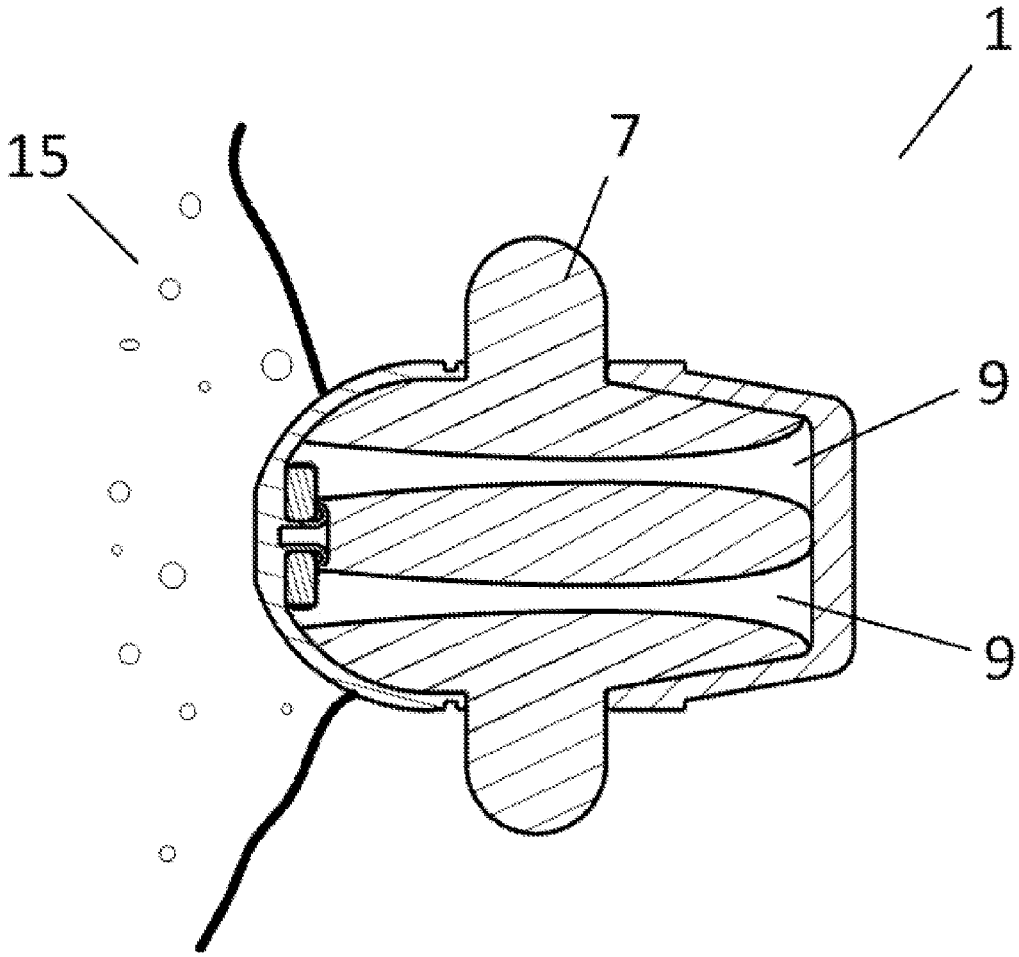
FIG. 10 is a cross sectional view of the spin stabilized, blunt impact, non-lethal projectile of the present invention, illustrating the lateral deformation of the compressible body upon impact thereof with the target, and the effect thereon provided by a multiple hollow core embodiment of the present invention.

Although one hollow core 9 may be utilized, as shown in FIGS. 2, 8 and 9, a plurality of hollow cores 9 may be utilized, as illustrated in FIG. 10. By utilizing a plurality of hollow cores 9, the compression/deformation characteristics of the compressible body 7 may be tailored to provide a desired impact profile. Further, as illustrated in FIG. 2, one or more perforations 8 may be disposed within the compressible body, extending from the one or more hollow cores to the outer circumference of the compressible body, to alter the compression/deformation characteristics of the compressible body 7.

Figure 4:
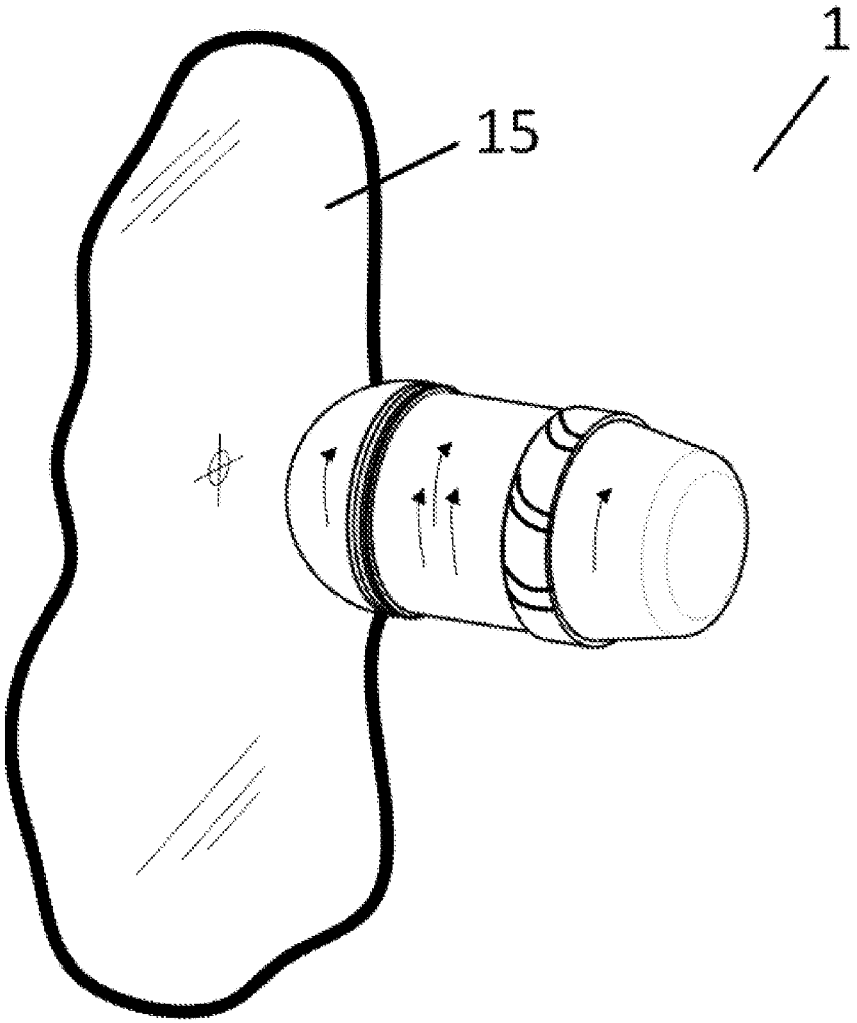
FIG. 4 is a rear perspective view of the spin stabilized, blunt impact, non-lethal projectile of the present invention after firing and just prior to impacting target, wherein the arrows depict the spin of the projectile during flight.
Figure 5:
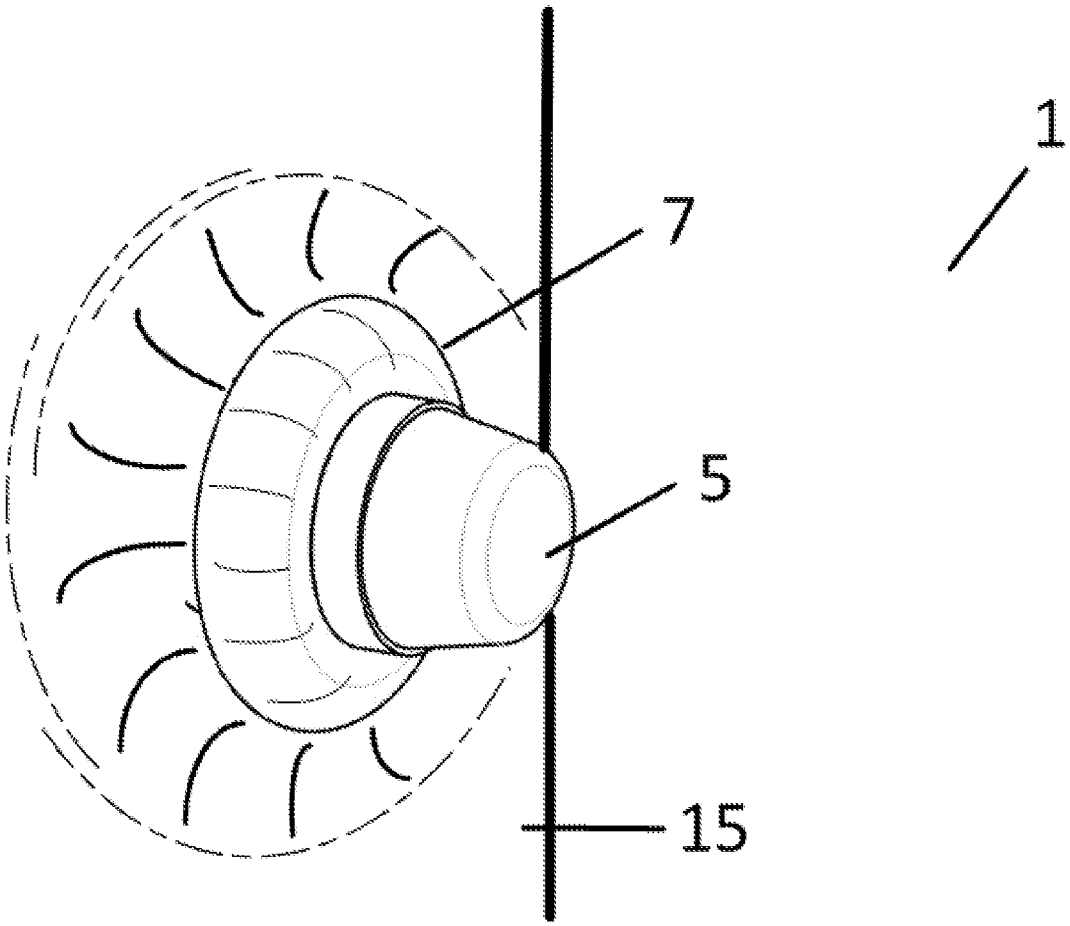
FIG. 5 is a rear perspective view of the projectile shown in FIG. 4 after impact thereof on the target, illustrating the compression/deformation of the compressible body.
Figure 6:
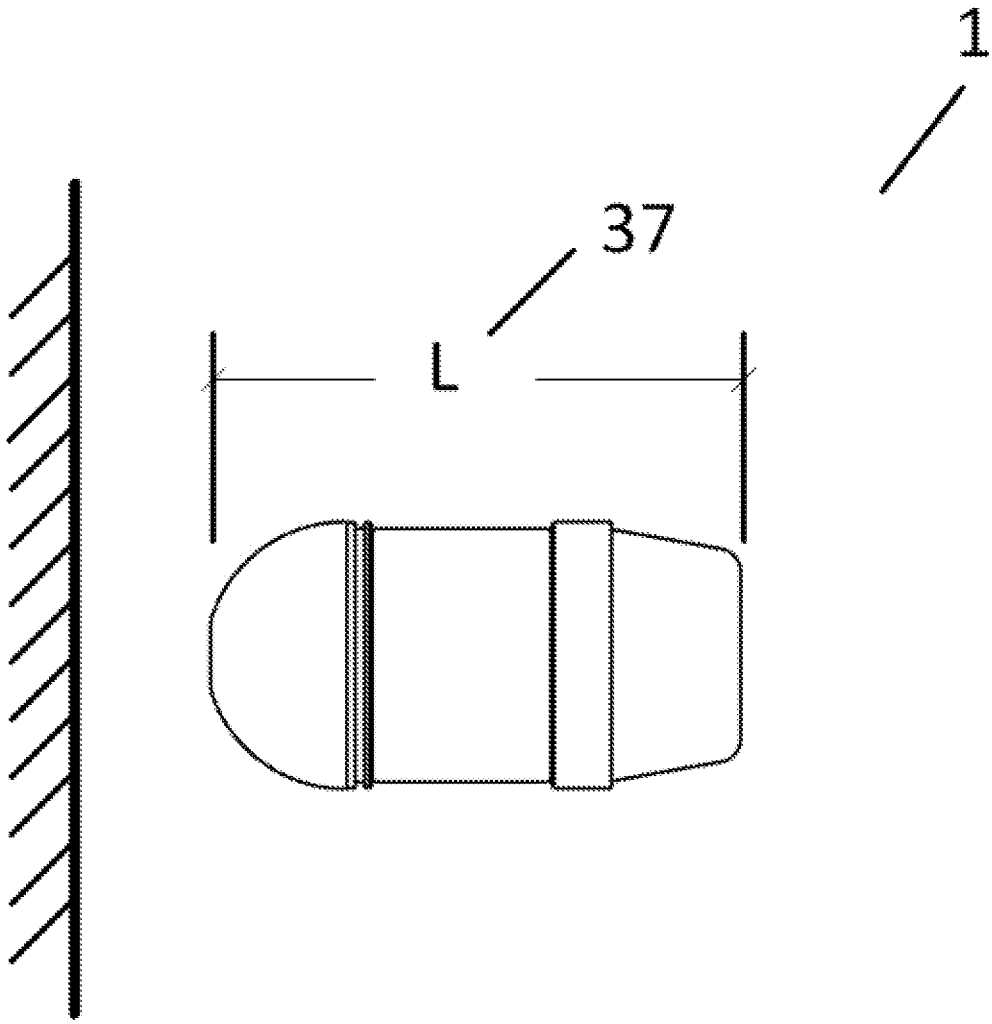
FIG. 6 is a side view of the projectile shown in FIGS. 4 and 5, illustrating an initial length of the projectile prior to impact thereof with the target.
Figure 7:
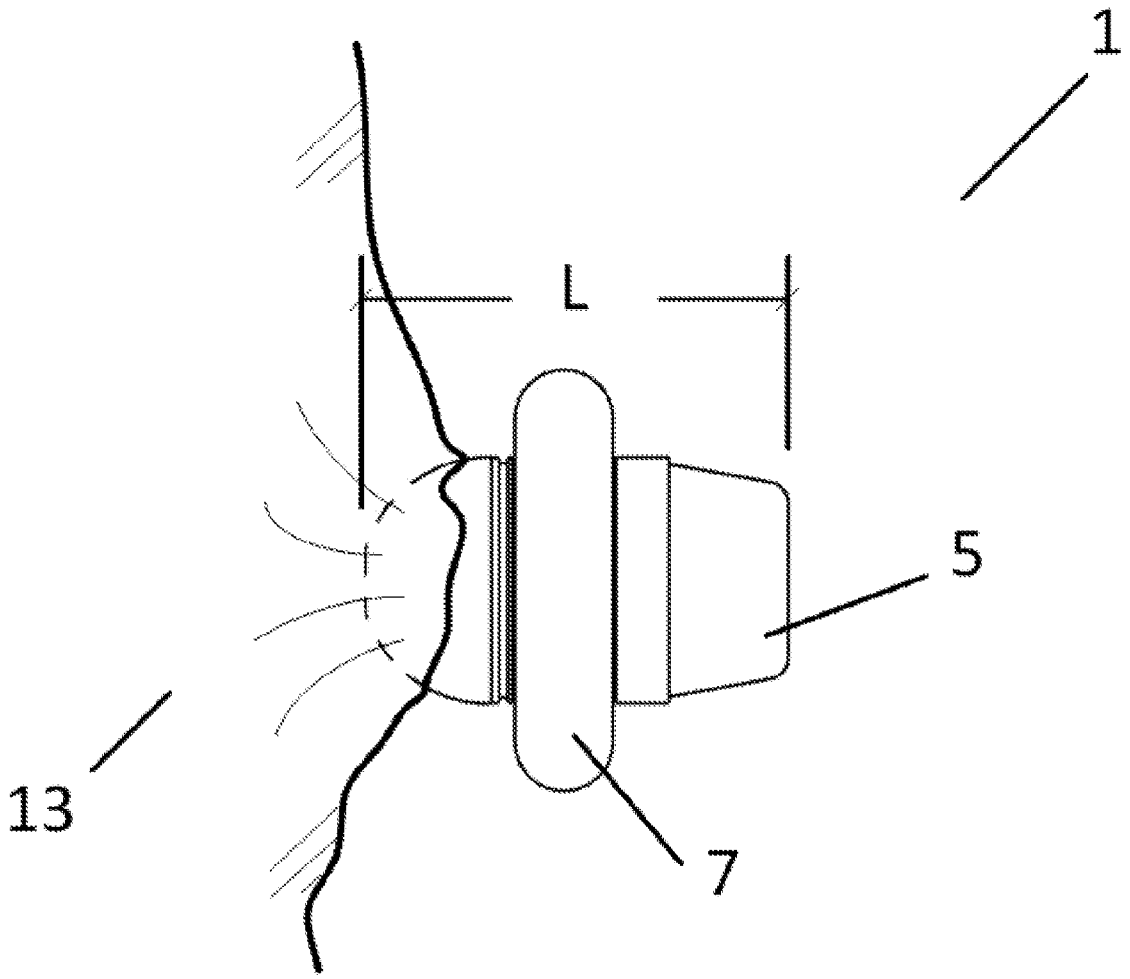
FIG. 7 is a side view of the projectile shown in FIGS. 4-6, illustrating the shortened overall length thereof after impact, due to compression/deformation of the compressible body.

In particular, as shown in FIGS. 4 and 5, the projectile 1 strikes target 15, causing the compressible body 7 to compress/deform. As shown in FIG. 8, the hollow core 9 allows the compressible body 7 to be compressed and deform, so as to laterally expand perpendicular to the axis of the hollow core 9, thereby decreasing the lengthening the time of impact, and lessening the instantaneous forces applied on the target 15. Accordingly, as illustrated in FIGS. 6 and 7, the overall length of the projectile 1 decreases from length 37 to length 39.

In order to alter the center of mass of the projectile 1, so as to provide balanced flight after firing, one or more weight biasing masses 17 may be disposed within the projectile 1, as illustrated in FIGS. 2 and 8. There is no limitation as to where these may be disposed. Rather, the weight biasing mass is disposed where appropriate to alter the center of mass, depending upon the projectile. Further, a ring weight 41 may be disposed on/within the projectile 1, which is operable to both add mass to the outer periphery/outer circumference of the projectile 1 so as to increase gyroscopic stability, as well as inherently provide rigidity and optionally rifling engagement to the outer circumference and/or base cap 5.

Figure 11:
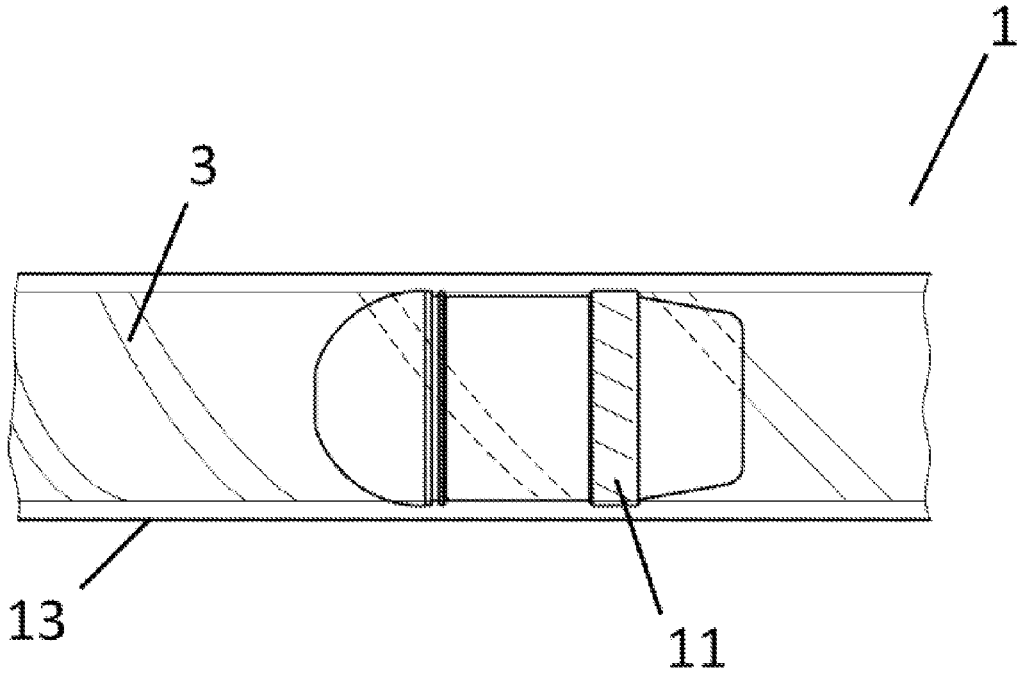
FIG. 11 is a partial transparent view of a portion of a rifled launch tube, such as a MK19 gun barrel, having the spin stabilized, blunt impact, non-lethal projectile of the present invention traveling therethrough.
Figure 12:
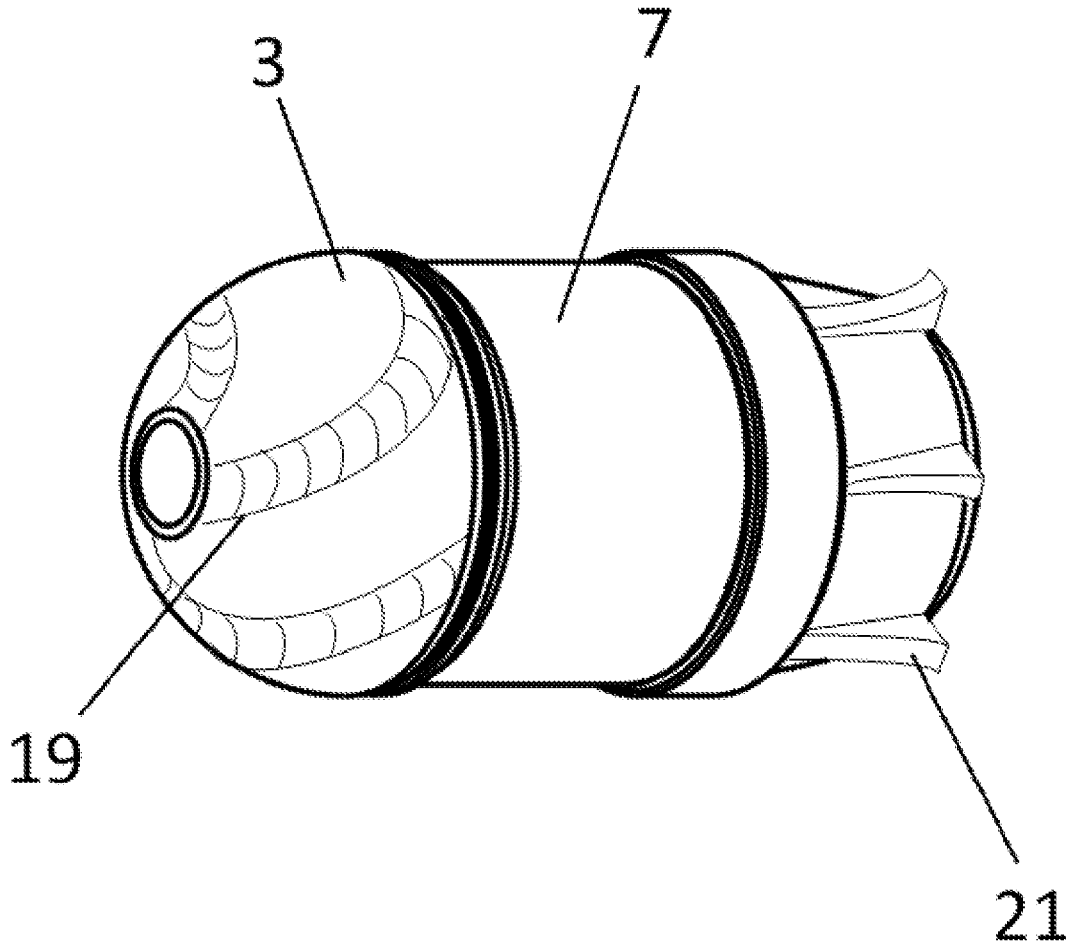
FIG. 12 is a front perspective view of the drag stabilized, blunt impact, non-lethal projectile of the present invention, illustrating the spiral grooves formed on/in the windscreen to impart spin to the projectile after firing, as well as the canted tail fins.
Figure 13:
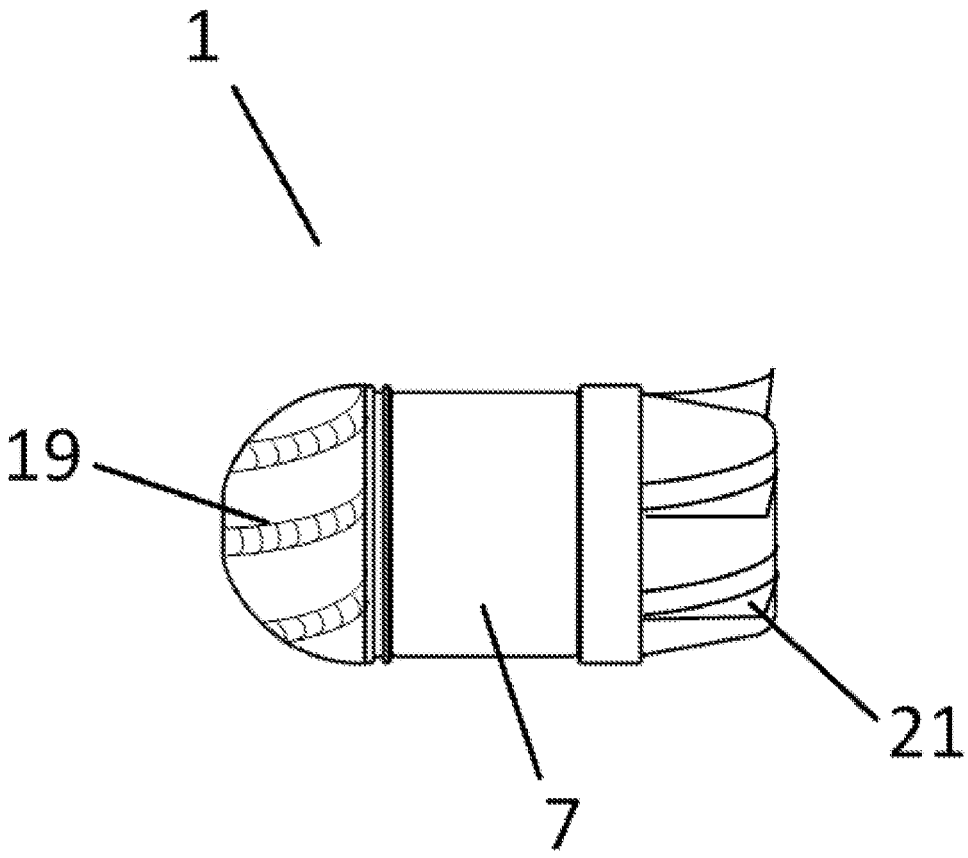
FIG. 13 is a side view of the drag stabilized, blunt impact, non-lethal projectile of the present invention.

In addition, as illustrated in FIGS. 3, 9 and 11, a rotating band 11 may be disposed on or formed integral with the rigid base cap 5. The rotating band 11 is operable to communicate with barrel rifling, i.e., for rifling engagement, as shown in FIG. 11, thereby enabling/increasing the spin of the projectile 1 after firing. As a further or alternative means of providing/increasing spin to the projectile 1 during and after firing, as illustrated in FIGS. 12 and 13, spiral grooves 19 may be provided on/in the windscreen 3.

Figure 14:
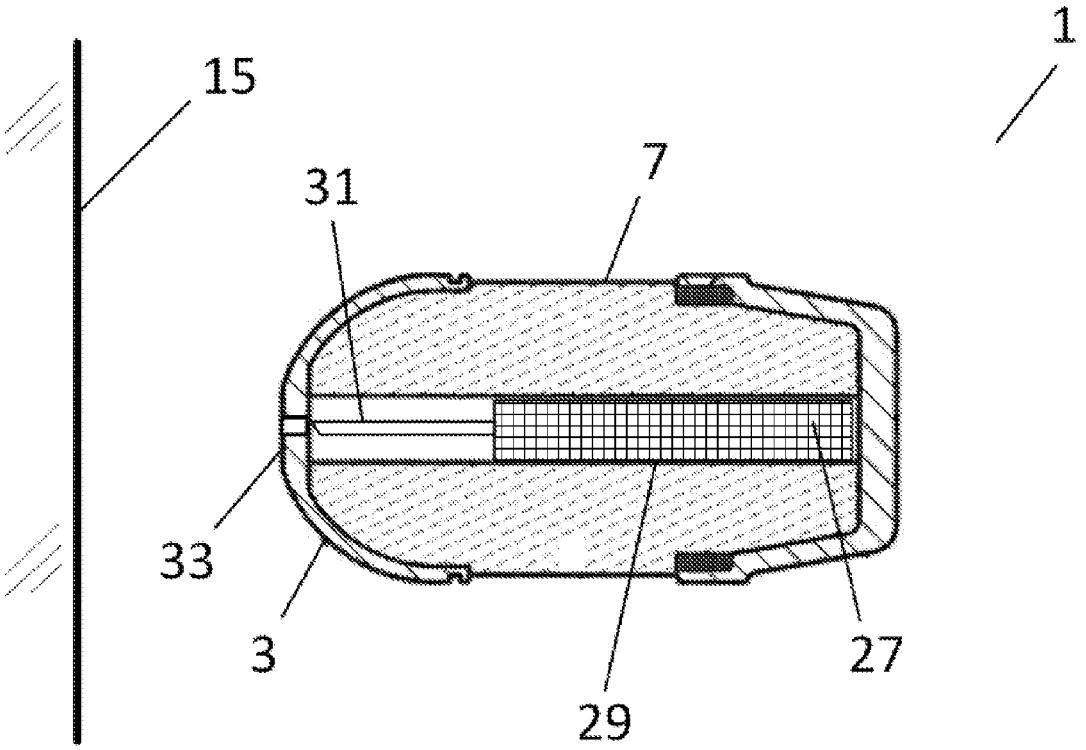
FIG. 14 is a cross sectional view of the of the spin stabilized, blunt impact, non-lethal projectile of the present invention, illustrating the agent reservoir disposed within the hollow core, as well as the agent ejection port disposed within/through the windscreen.
Figure 15:
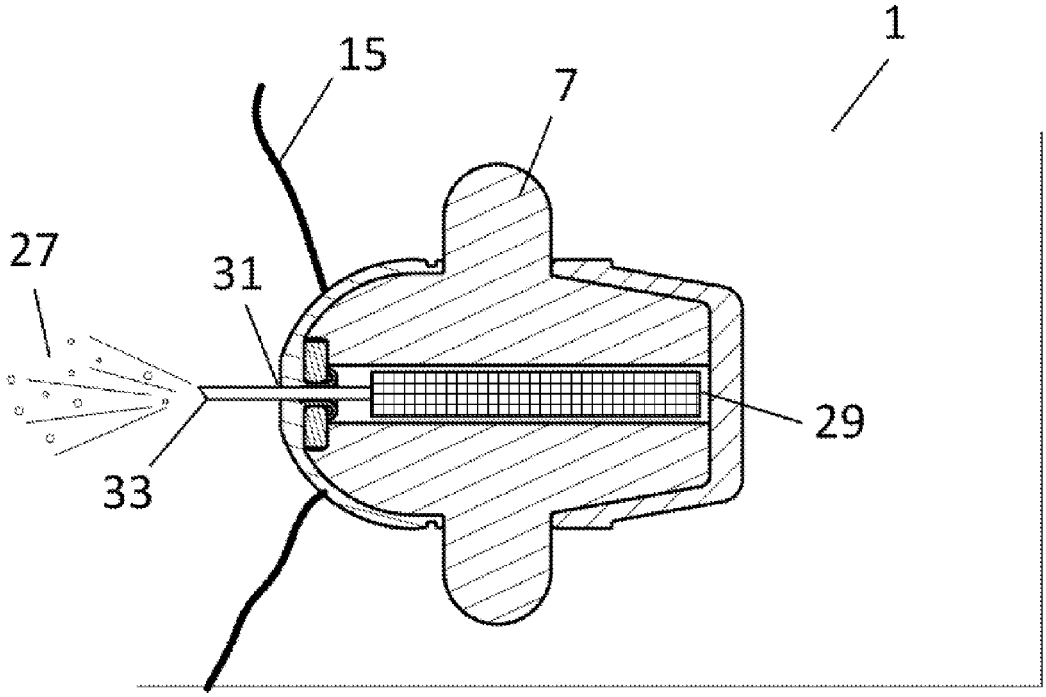
FIG. 15 is a cross sectional view of the projectile shown in FIG. 14, illustrating the projectile after impaction thereof on a target, and the subsequent deformation of the compressible body and ejection of the agent from the agent reservoir through the ejection nozzle and agent ejection port onto the target. The compression of the overall length of the projectile has forced the ejection nozzle to extend through the agent ejection port and eject/release the agent.

In a preferred embodiment, as illustrated in FIGS. 14 and 15, the projectile 1 of the present invention may contain an agent reservoir 29 disposed within the hollow core 9 of compressible body 7. The agent reservoir 29 is operable to retain one or more agents 27. Such agents 27, as shown in FIG. 14, may be any material/composition which a user may wish to deliver to a target. In a preferred embodiment, the agent is one or more of a powder, marking agent, crowd control agent (i.e., a chemical irritant), tranquilizer, toxin, etc.

For example, as shown in FIG. 14, prior to impact upon the target 15, the agent 27 is contained within the agent reservoir 29. However, as illustrated in FIG. 15, upon impact of the projectile 1 upon the target 15, the projectile 1 is compressed, thereby forcing the agent ejection nozzle 31 to pierce and/or protrude through the windscreen ejection port 33. As clearly illustrated in FIG. 15, as the agent ejection nozzle 31 is in communication with the agent reservoir 29, when the agent ejection nozzle 31 pierces the windscreen ejection port 33 (which may be temporarily sealed by, for example, an adhesive tape, break away plastic tab, etc.), the agent 27 is emitted/ejected through the windscreen ejection port 33 and onto the target 15.

In another preferred embodiment, the projectile 1 shown above may be configured as a drag-stabilized projectile. Namely, as illustrated in FIGS. 12 and 13, the projectile 1 may be fitted with canted fins 21. Such canted fins 21, which may be disposed on or formed integral with the base cap 5, act to control orientation of the projectile during flight via drag exerted thereon, much like an arrow. The spiral grooves 19, as shown in FIGS. 12 and 13, further increase/improve the spin of the projectile 1 during firing, thereby improving the accuracy of the projectile 1.

Figure 19:
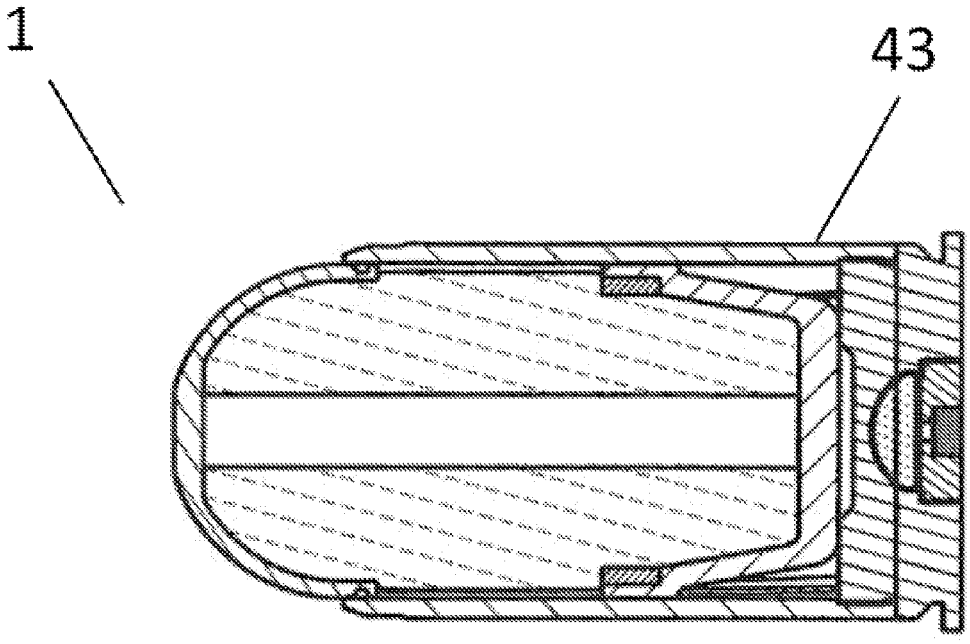
FIG. 19 is a cross sectional view of the projectile shown in FIG. 18 in a low velocity cartridge body.
Figure 20:
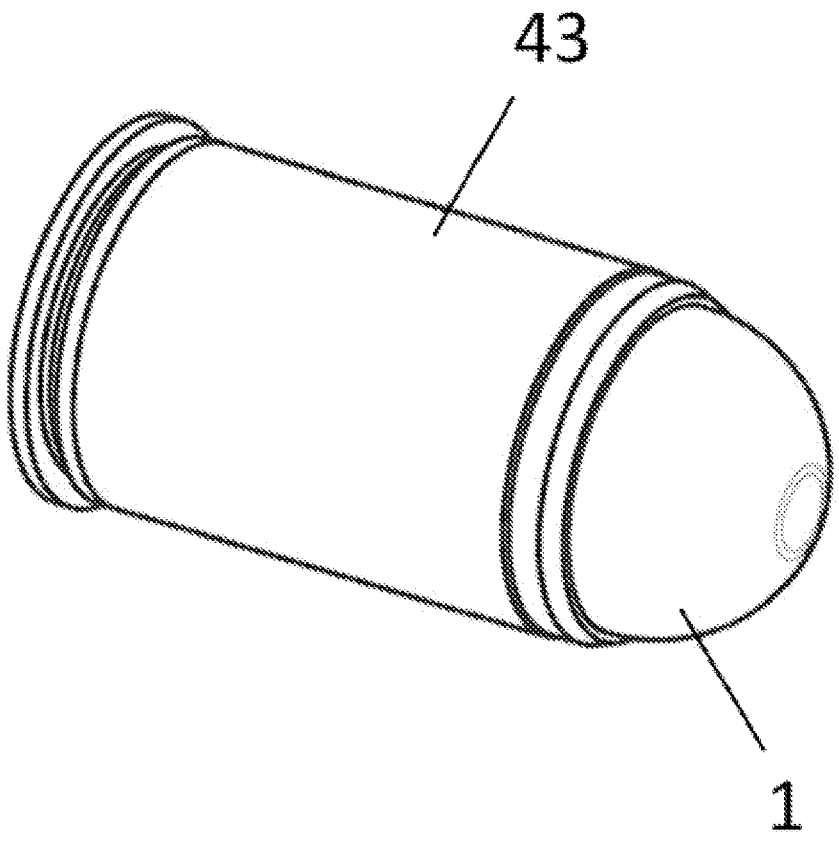
FIG. 20 is a front perspective view of the projectile and cartridge body shown in FIG. 19.
Figure 21:
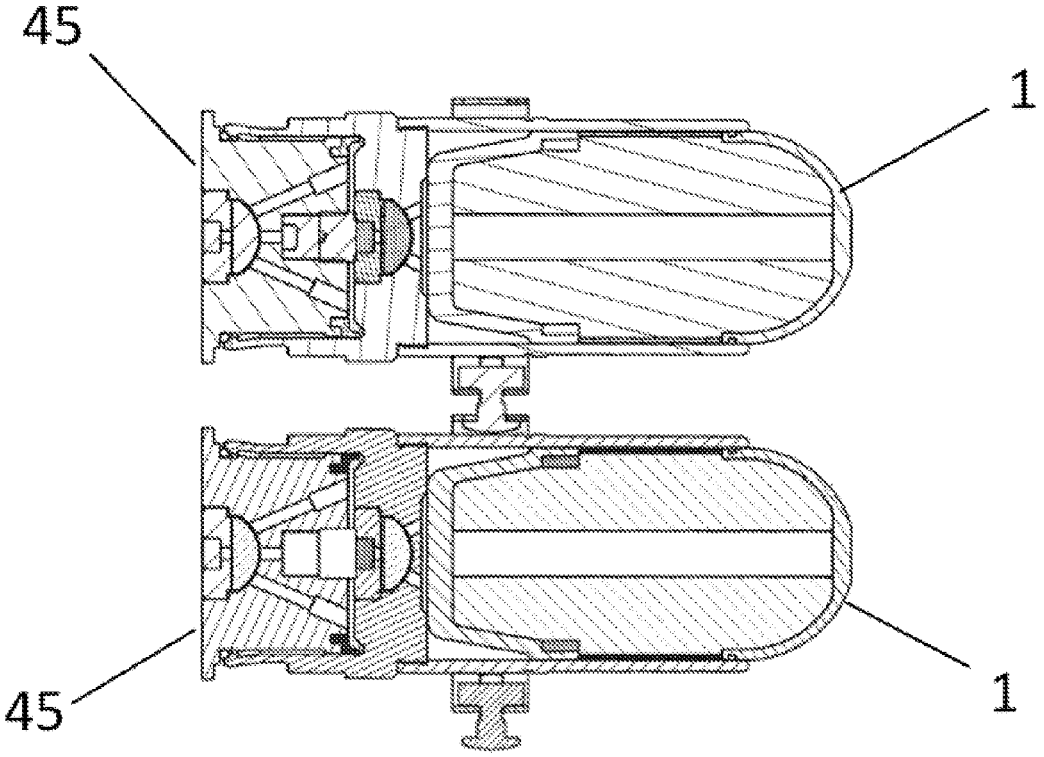
FIG. 21 is a cross sectional view of the projectile of the present invention utilized in a belted, high velocity telescoping cartridge assembly.
Figure 22:
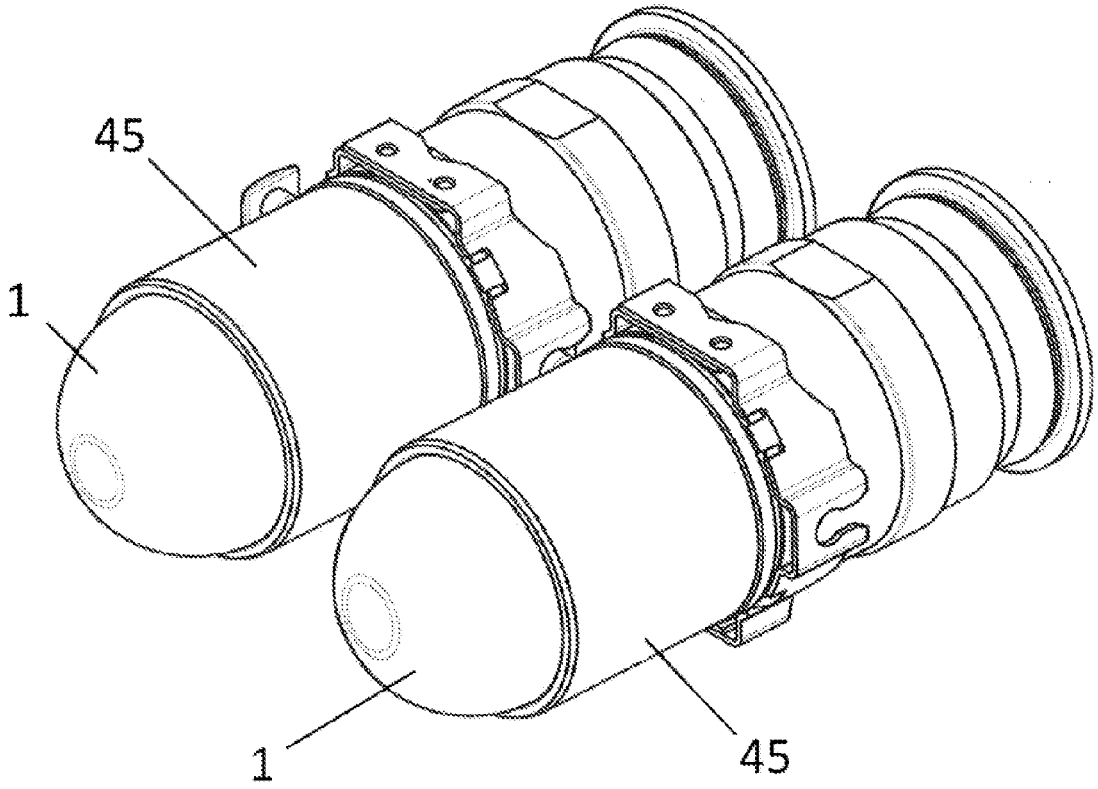
FIG. 22 is a front perspective view of the projectile of the present invention utilized in a belted, high velocity telescoping cartridge assembly shown in FIG. 22.

As mentioned above, and as illustrated in FIGS. 19-22, the projectile 1 of the present invention may be utilized in various existing cartridges. For example, FIGS. 19 and 20 illustrate the spin-stabilized version of the projectile 1 in a low velocity cartridge body operable to be fired in 40 mm weapons, such as the M203. In another example, the projectile 1 of the present invention may be utilized in a belted, high velocity telescoping cartridge assembly for the Mk19, as illustrated in FIGS. 21 and 22. Accordingly, the projectile of the present invention provides a very flexible platform for application in a wide variety of weaponry/ammunition.

Figure 16:
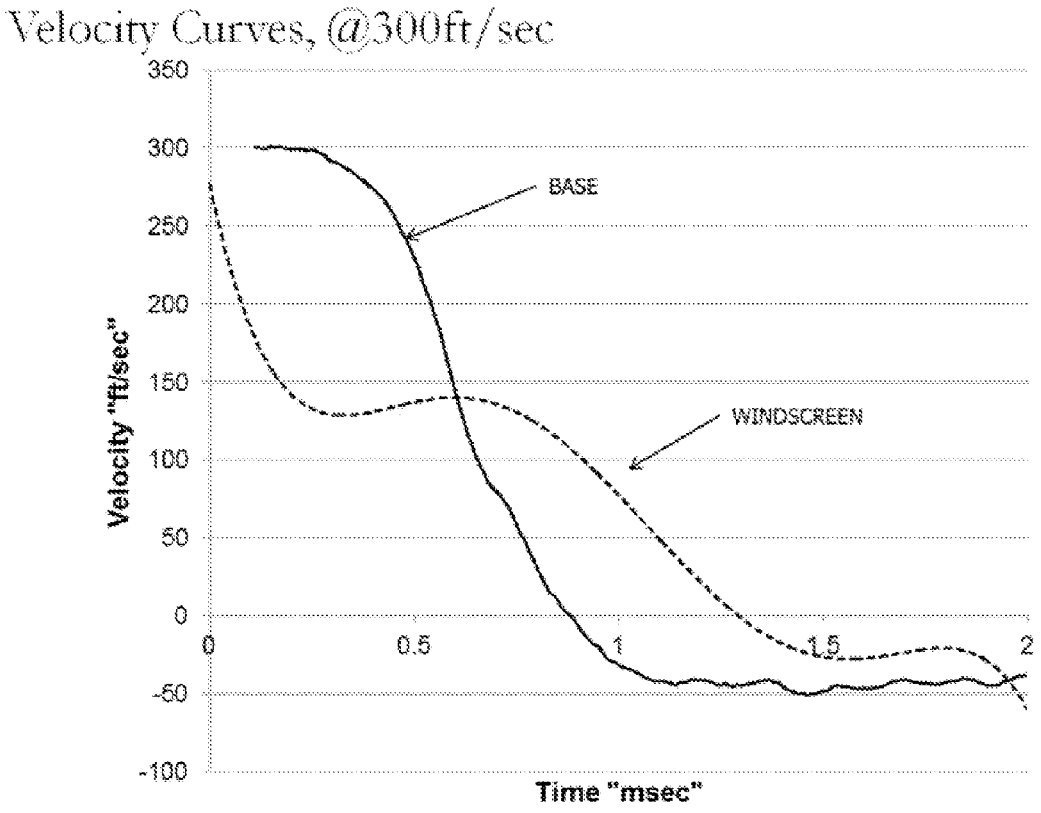
FIG. 16 is a graph of velocity vs. time of a simulated target impact with of a target by the windscreen and base of a projectile of the present invention.

The present inventor designed/ran simulated computer models to determine the velocity of the windscreen and base of a spin-stabilized projectile of the present invention vs. time when the projectile of the present invention impacts a clay target. In particular, as shown in FIG. 16, the graphical data shows that the base of the projectile continues to move (travel forward) while the nose is decelerating from the impact with the target. This means that the base is still not applying kinetic energy to the target until the nose is almost done dumping its energy. Accordingly, the total impact is spread out over a longer time period, rather than being hit by a solid object whereby it would hit all at once.

Figure 17:
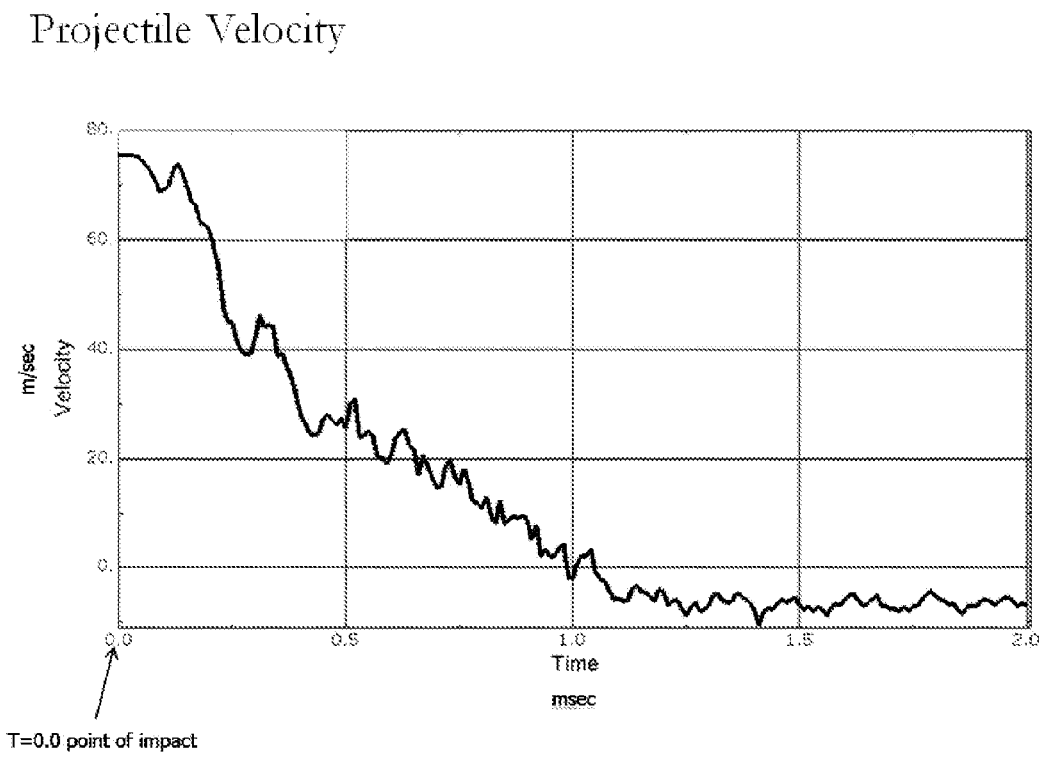
FIG. 17 is a graph of velocity vs. time of an M1006 projectile impacting a simulated target.
Figure 18:
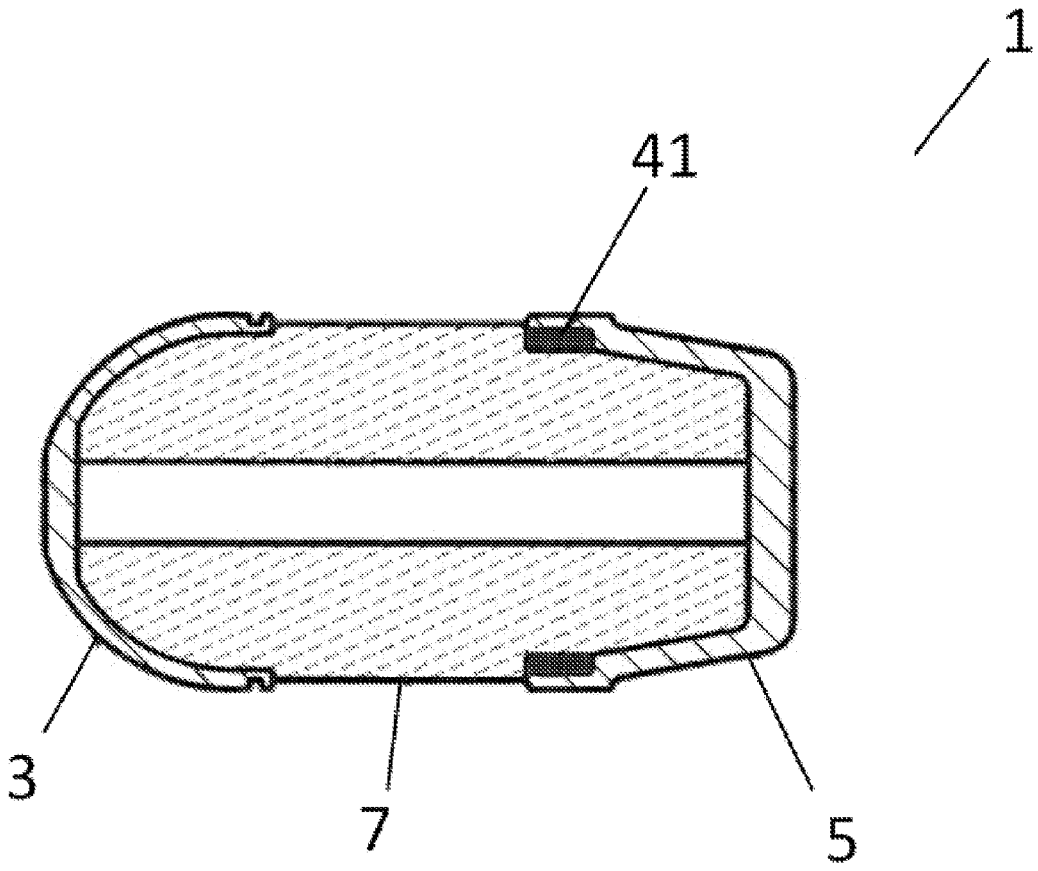
FIG. 18 is a cross sectional view of the spin stabilized, blunt impact, non-lethal projectile of the present invention, illustrating the disposition of the ring weight therein.

In addition, the present inventor conducted/ran simulated computer models to determine the velocity of a conventional M1006 projectile vs. time when such projectile impacts a simulated clay target, the results of which are shown in the graph in FIG. 17. As illustrated in FIG. 17, all of the kinetic energy is dissipated quickly upon impact, which indicates a strong impact, perhaps lethal, upon the target. Accordingly, it can be seen by comparing the graphs of FIGS. 16 and 17 that the drawn out impact event experienced by a target upon impact with the projectile of the present invention is much less damaging (i.e., less lethal) than an impact by a conventional M1006 projectile. However, the projectile of the present invention is capable of maintaining sufficient velocity and range to be fired by various conventional weapons in various situations.

Although specific embodiments of the present invention have been disclosed herein, those having ordinary skill in the art will understand that changes can be made to the specific embodiments without departing from the spirit and scope of the invention. Thus, the scope of the invention is not to be restricted to the specific embodiments. Furthermore, it is intended that the appended claims cover any and all such applications, modifications, and embodiments within the scope of the present invention.

LIST OF DRAWING ELEMENTS

1: spin stabilized/drag stabilized, blunt impact, non-lethal projectile
3: windscreen
5: rigid base cap
7: compressible body
8: perforation
9: hollow core
11: rotating band
13: rounded nose of windscreen
15: target
16: support
17: weight biasing mass
19: spiral grooves to impart spin (Drag versions)
21: canted fins (drag versions)
23: barrel or payload carrier
25: rifling
27: agent (i.e., ejected material, such as powder, marking agent, tranquilizer, poison)
29: agent reservoir
31: agent ejection nozzle
33: windscreen ejection port (in communication with agent ejection port 31)
35: taper in rigid base cup
37: initial length of projectile (before impact)
39: length of projectile after impact thereof on target
41: ring weight (for gyroscopic stability)
43: Low velocity cartridge case (for M203, M32, M79, M320 use)
45: High velocity telescoping cartridge case (Mk19, Mk47)

What is claimed is:

1. A spin stabilized, blunt impact, non-lethal projectile comprising:

(a) a compressible body having a front end, a base opposite the front end, and a body portion therebetween, said body portion having an outer circumference;

(b) a rigid windscreen disposed on or adjacent to the front of the compressible body, so as to cover a portion thereof;

(c) a rigid base cap disposed on or adjacent to the base of he compressible body, so as to cover a portion thereof, wherein the compressible body is comprised of a compressible material or a frangible material operable to compress flex, or both upon impact of said spin stabilized, blunt impact, non-lethal projectile after; and (d) rigid supports positioned around the outer circumference between said ridged windscreen and said rigid base cap, wherein said rigid support prevent compression or flex of said compressible body during firing and are configured to fall away from said spin stabilized, blunt impact, non-lethal projectile after exiting a weapon.

2. The spin stabilized, blunt impact, non-lethal projectile of claim 1, wherein the compressible body further comprises one or more hollow cores disposed within the body portion, said hollow cores extending substantially from the front end to the base.

3. The spin stabilized, blunt impact, non-lethal projectile of claim 2, further comprising one or more perforations disposed within the compressible body, extending from the one or more hollow cores to the outer circumference of the compressible body.

4. The spin stabilized, blunt impact, non-lethal projectile of claim 2, further comprising:

an agent reservoir disposed within the compressible body, wherein said agent reservoir is operable to retain one or more agents therein, and release same upon impact of said spin stabilized, blunt impact, non-lethal projectile.

5. The spin stabilized, blunt impact, non-lethal projectile of claim 4, wherein the one or more agents are selected from powders, marking agents, chemical irritants, toxic compositions and tranquilizers.

6. The spin stabilized, blunt impact, non-lethal projectile of claim 4, further comprising:

one or more agent ejection ports disposed within the body portion and windscreen so as to extend from the windscreen to the hollow core, wherein said one or more ejection ports are operable to facilitate transmission of an agent through the one or more agent ejection ports impact of said spin stabilized, blunt impact, non-lethal projectile.

7. The spin stabilized, blunt impact, non-lethal projectile of claim 5, further comprising:

one or more agent ejection ports disposed within the body portion and windscreen so as to extend from the windscreen to the hollow core, wherein said one or more ejection ports are operable to facilitate transmission of an agent through the one or more agent ejection ports impact of said spin stabilized, blunt impact, non-lethal projectile.

8. The spin stabilized, blunt impact, non-lethal projectile of claim 2, further comprising:

one or more agent ejection ports disposed within the body portion and windscreen so as to extend from the windscreen to the hollow core, wherein said one or more ejection ports are operable to facilitate transmission of an agent through the one or more agent ejection ports upon impact of said spin stabilized, blunt impact, non-lethal projectile.

9. The spin stabilized, blunt impact, non-lethal projectile of claim 2, further comprising one or more spiral grooves disposed within the windscreen, said spiral grooves operable to impart spin to said spin stabilized, blunt impact, non-lethal projectile upon firing thereof.

10. The spin stabilized, blunt impact, non-lethal projectile of claim 2, further comprising a rotating band disposed around or formed integral with the base of spin stabilized, blunt impact, non-lethal projectile, said rotating band operable to communicate with rifling of a weapon barrel.

11. The spin stabilized, blunt impact, non-lethal projectile of claim 1, further comprising a weight biasing mass disposed within or adjacent to the forward end of the compressible body, said weight biasing mass operable to alter the center of mass of said spin stabilized, blunt impact, non-lethal projectile.

12. The spin stabilized, blunt impact, non-lethal projectile of claim 1, further comprising a ring weight disposed integral with, adjacent to or around the projectile, said ring weight operable to increase mass around the circumference of said spin stabilized, blunt impact, non-lethal projectile, thereby increasing gyroscopic stability of the projectile.

13. The spin stabilized, blunt impact, non-lethal projectile of claim 1, wherein the rigid base cap decrease in diameter from a front end thereof to a rear end thereof, such that the rear end of the base cap has a diameter smaller than the front end of the compressible body and maximum diameter of the windscreen.

14. A drag stabilized, blunt impact, non-lethal projectile comprising:

(a) a compressible body having a front end, a base opposite the front end, and a body portion therebetween, said body portion having an outer circumference;

(b) a rigid windscreen disposed on or adjacent to the front of the compressible body, so as to cover a portion thereof;

(c) a rigid base cap disposed on or adjacent to the base of the compressible body, so as to cover a portion thereof, said rigid base cap having one or more canted fins disposed thereon, wherein the compressible body is comprised of a compressible material or frangible material operable to compress flex or both upon impact of said drag stabilized, blunt impact, non-lethal projectile, and said canted fins are operable to impart spin to the projectile after firing thereof; and (d) rigid supports positioned around the outer circumference between said ridged windscreen and said rigid base cap, wherein said rigid support prevent compression or flex of said compressible body during firing and are configured to fall away from said drag stabilized, blunt impact, non-lethal projectile after exiting a weapon.

15. The drag stabilized, blunt impact, non-lethal projectile of claim 14, wherein the compressible body further comprises one or more hollow cores disposed within the body portion, said hollow cores extending substantially from the front end to the base.

16. The drag stabilized, blunt impact, non-lethal projectile of claim 15, further comprising one or more perforations disposed within the compressible body, extending from the one or more hollow cores to the outer circumference of the compressible body.

17. The drag stabilized, blunt impact, non-lethal projectile of claim 14, further comprising:

an agent reservoir disposed within the compressible body, wherein said agent reservoir is operable to retain one or more agents therein, and release same upon impact of said drag stabilized, blunt impact, non-lethal projectile.

18. The drag stabilized, blunt impact, non-lethal projectile of claim 17, wherein the one or more agents are selected from powders, marking agents, chemical irritants, toxic compositions and tranquilizers.

19. The drag stabilized, blunt impact, non-lethal projectile of claim 18, further comprising:

one or more agent ejection ports disposed within the body portion and windscreen so as to extend from the windscreen to the hollow core, wherein said one or more ejection ports are operable to facilitate transmission of an agent through the one or more agent ejection ports impact of said drag stabilized, blunt impact, non-lethal projectile.

20. The drag stabilized, blunt impact, non-lethal projectile of claim 17, further comprising:

one or more agent ejection ports disposed within the body portion and windscreen so as to extend from the windscreen to the hollow core, wherein said one or more ejection ports are operable to facilitate transmission of an agent through the one or more agent ejection ports upon impact of said drag stabilized, blunt impact, non-lethal projectile.

21. The drag stabilized, blunt impact, non-lethal projectile of claim 20, further comprising:

one or more agent ejection ports disposed within the body portion and windscreen so as to extend from the windscreen to the hollow core, wherein said one or more ejection ports are operable to facilitate transmission of an agent through the one or more agent ejection ports impact of said drag stabilized, blunt impact, non-lethal projectile.

22. The drag stabilized, blunt impact, non-lethal projectile of claim 14, further comprising a weight biasing mass disposed within or adjacent to the forward end of the compressible body, said weight biasing mass operable to alter the center of mass of said drag stabilized, blunt impact, non-lethal projectile.

23. The drag stabilized, blunt impact, non-lethal projectile of claim 14, further comprising one or more spiral grooves disposed within the windscreen, said spiral grooves operable to impart spin to said drag stabilized, blunt impact, non-lethal projectile upon firing thereof.

24. The drag stabilized, blunt impact, non-lethal projectile of claim 14, further comprising a rotating band disposed around or formed integral with the base of said drag stabilized, blunt impact, non-lethal projectile, said rotating band operable to communicate with rifling of a weapon barrel.

25. The drag stabilized, blunt impact, non-lethal projectile of claim 14, further comprising a ring weight disposed integral with, adjacent to or around said drag stabilized, blunt impact, non-lethal projectile, said ring weight operable to increase mass around the circumference of the projectile, thereby increasing gyroscopic stability of the projectile.

26. The drag stabilized, blunt impact, non-lethal projectile of claim 14, wherein the rigid base cap decrease in diameter from a front end thereof to a rear end thereof, such that the rear end of the base cap has a diameter smaller than the front end of the compressible body and maximum diameter of the windscreen.

* * * * *